United States Patent [19]

Schade, Jr.

[11] 4,234,841

[45] Nov. 18, 1980

[54] SELF-BALANCING BRIDGE NETWORK

[75] Inventor: Otto H. Schade, Jr,, North Caldwell, N.J.

[73] Assignee: RCA Corporation, New York, N.Y.

[21] Appl. No.: 9,350

[22] Filed: Feb. 5, 1979

[51] Int. Cl.[3] ..... G05F 3/08

[52] U.S. Cl. ..... 323/1; 323/4; 323/22 T; 330/257

[58] Field of Search ..... 323/1, 4, 9, 19, 22 T, 323/22 R; 307/296 R, 297; 330/252, 257, 288

[56] References Cited

U.S. PATENT DOCUMENTS

| | | | |
|---|---|---|---|
| 3,629,691 | 12/1971 | Wheatley, Jr. | 323/1 |
| 3,649,926 | 3/1972 | Hill | 323/1 X |
| 3,887,863 | 6/1975 | Brokaw | 323/1 X |
| 3,904,976 | 9/1975 | Ahmed | 323/1 X |
| 3,911,353 | 10/1975 | van de Plassche | 323/1 |
| 3,914,683 | 10/1975 | van de Plassche | 323/22 T X |
| 4,063,149 | 12/1977 | Crowle | 323/4 |
| 4,087,758 | 5/1978 | Hareyama | 330/261 |

FOREIGN PATENT DOCUMENTS 1373133 11/1974 United Kingdom .

*Primary Examiner*—William M. Shoop
*Assistant Examiner*—Peter S. Wong
*Attorney, Agent, or Firm*—Eugene M. Whitacre; Paul J. Rasmussen; Allen LeRoy Limberg

[57] ABSTRACT

A self-balancing bridge network has first and second terminals defining a port for receiving power and has third and fourth terminals defining a port across which voltage is to be nulled. Transistors are located between each terminal of the port for receiving power and each terminal of the port across which voltage is to be nulled. A pair of these transistors are differentially degenerated, so that balancing of the bridge establishes predetermined levels of current in all the transistors. Such bridges are useful in two terminal current regulation, reference current sources, and in reference voltage sources.

24 Claims, 8 Drawing Figures

SELF-BALANCING BRIDGE NETWORK

The present invention relates to self-balancing bridge networks as used, for example, in two terminal current regulators, in reference current sources, and in reference voltage sources, of types usually constructed in monolithic integrated form.

The second edition of *IEEE Standard Dictionary of Electrical and Electronics Terms* published by The Institute of Electrical and Electronics Engineers, Inc., New York, N.Y., defines "bridge" or "bridge network" as a "network with a minimum of two ports or terminal pairs capable of being operated in such a manner that when power is fed into one port, by suitable adjustment of elements in the network or of elements connected to one or more other ports, zero output can be obtained at another port. Under these conditions the bridge is balanced". That is, balanced with respect to an "output" port across which zero output is obtained. A self-balancing bridge is defined herein as a bridge network in which the output at an output port is sensed to control the adjustment of elements in the network or of elements connected to one or more other ports to null that sensed output. Assuming such a bridge network to receive energization at a single port, that port will be denominated the "input" port in this specification.

Now, it is conventional to think of bridge networks in terms of voltage parameters, and of self-balancing bridge networks in terms of sensing difference in voltage between the terminals of the output port to control adjustment of elements in the network, or of elements connected to one or more of the other ports, so as to minimize that difference. However, to understand the present invention fully, one should also comprehend bridge networks in terms of current parameters. More specifically, one should think of self-balancing bridge networks also in terms of sensing the flow of current between the terminals of an output port to control adjustments to minimize that flow. When this is done, one will become aware that the IEEE definition is biased towards consideration of bridge networks in voltage parameters, particularly with regard to the form of the output, inasmuch as the current flowing through an "output" terminal does so without reference to any other specific terminal which pairs with it to form an output port. So a class of bridge networks, in each of which current flowing through an output terminal returns to the bridge network through a plurality of other terminals, is not within the comprehension of the IEEE definition. The present specification will extend the definition of bridge network to include this class. This comprehensive view of bridge networks is desirable since the genius of the present invention reposes in large part in the simultaneous self-balancing of two different parts of a bridge network, one being balanced with respect to voltage and the other being balanced with respect to current.

The present invention is embodied in a self-balancing bridge network comprising first, second, third and fourth transistors each having a respective input electrode (i.e., base or gate electrode), a respective output electrode (i.e., collector or drain electrode), and a respective common electrode (i.e., emitter or source electrode). First and second terminals define an input port for connection to an energizing supply, and third and fourth terminals define an output port across which voltage is to be nulled. The common electrodes of the first and second transistors, which are both bipolar or both field effect transistors with proportional conduction characteristics, are galvanically connected to the first terminal of the bridge. The common electrodes of the third and fourth transistors, which are both bipolar or both field effect transistors, are galvanically connected to the second terminal of the bridge. The output electrodes of the first and fourth transistors galvanically connect to the third terminal of the bridge, and the output electrodes of the second and third transistors galvanically connect to its fourth terminal. Direct-coupled feedback from the third terminal to an interconnection between the input electrodes of the first and second transistors establishes the potential offset between the first and third terminals and completes the connection of the first and second transistors as a first current amplifier with input and output connections at the third terminal and at the fourth terminal, respectively. In order to further the end of reducing the potential across the output port defined by the third and fourth terminals, a differential-input amplifier has an inverting connection at said third terminal, a noninverting connection at said fourth terminal, and an output connection at an interconnection between the input electrodes of said third and fourth transistors. This differential-input amplifier also connects said third and fourth transistors as a second current amplifier with input connections at the fourth terminal and at the third terminal, respectively. The output current versus input voltage characteristics of the first, second, third and fourth transistors are so chosen that the resulting regenerative loop connection of the first and second current amplifiers tends to increase the levels of the transistor output currents over a range of currents below prescribed values. This tendency is checked by current-mode feedback provided by differentially degenerating the transistors in at least one of the first and second current amplifiers.

Figure 1:
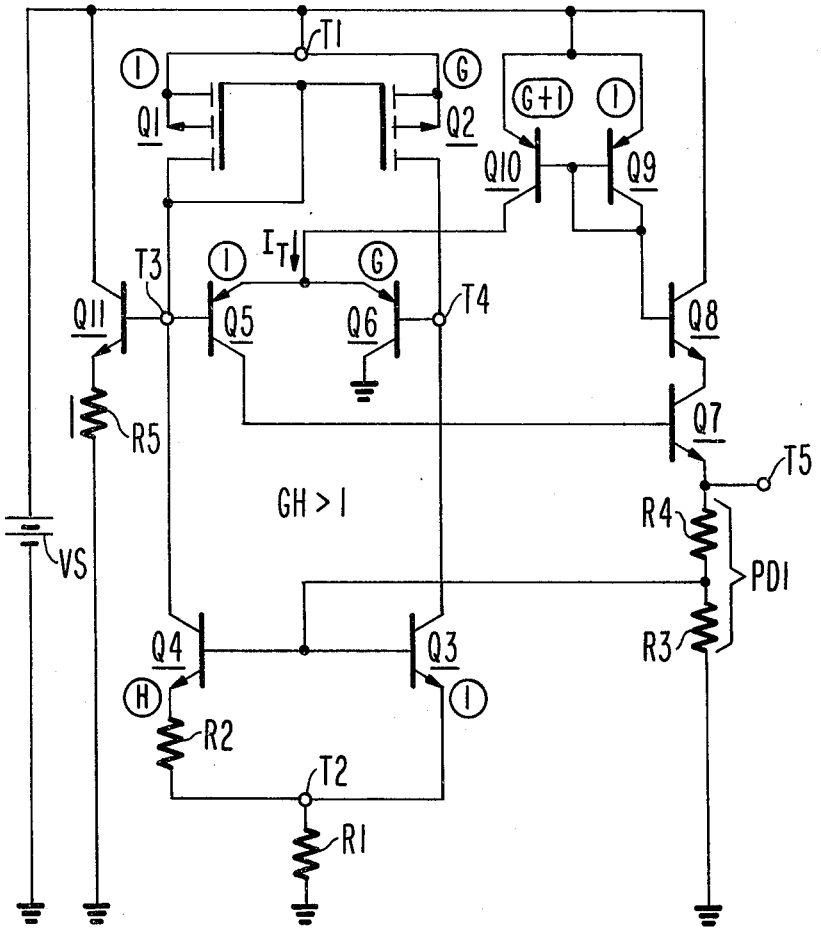
FIG. 1 is a schematic diagram of a reference voltage supply including a self-balancing bridge network, which embodies the present invention.

FIG. 1 shows a reference voltage supply which includes a self-balancing bridge network of the sort described above. The input port of the bridge network is between first and second terminals T1 and T2. T1 is connected to the positive pole of a source VS of energizing potential, and T2 is connected via a resistor R1 to the negative pole of VS, shown as being grounded. The output port of the bridge network is between third and fourth terminals T3 and T4. First and second transistors Q1 and Q2 are enhancement-mode p-channel insulated-gate field effect transistors having respective conductances in 1:G ratio for all levels of their similar source-to-gate potentials, where G is a positive constant, as symbolized by the encircled "1" and "G" near their respective source electrodes. Third and fourth transistors Q3 and Q4 are NPN bipolar transistors which would have emitter-to-collector currents in 1:H ratio at all levels of their emitter-to-base potentials, where H is a positive constant, were their emitter-to-base potentials equal, as symbolized by the encircled "1" and "H" near their respective emitter electrodes.

Q1 and Q2 are connected as a current amplifier of current mirror amplifier type having input, output and common connections at terminals T3, T4 and T1, respectively, and exhibiting a constant current gain of −G between terminals T3 and T4. The direct-coupled drain-to-gate feedback provided by the direct connection between the drain and gate electrodes of Q1 adjusts its source-to-gate potential $V_{GSQ1}$ to such value as to condition it to conduct a source-to-drain current $I_{DSQ1}$ any current demand presented to its drain electrode, and the application of $V_{GS1}$ as the source-to-gate potential $V_{GS2}$ of Q2 conditions Q2 to conduct as source-to-drain current $I_{DSQ2}$ a current G times as large as $I_{DSQ1}$ in amplitude.

Q3 and Q4 are included in a non-linear current amplifier having input, output and common connections at terminals T4, T3 and T2, respectively. Q3 is provided with direct-coupled collector-to-base feedback that adjusts its emitter-to-base potential $V_{BEQ3}$ to condition Q3 to conduct as its collector current $I_{CQ3}$ the current applied to terminal T4. $V_{BEQ3}$ is applied to the series connection of the base-emitter junction of Q4 and a resistor R2. At low levels of current applied to T4, $V_{BEQ3}$ will be of the reduced value to support a commensurate collector current $I_{CQ3}$ demand. The application of this reduced value of $V_{BEQ3}$ to the series connection of the base-emitter junction of Q3 and resistor R2 will cause conduction at low levels in Q4. A low level of emitter current from Q4 will keep the potential drop across R2 small. So at very low levels of current the emitter-to-base potential $V_{BEQ4}$ of Q4 is substantially equal to $V_{BEQ3}$, so in a way analogous to the current mirror amplifier action described above, the current gain of the non-linear current amplifier will be −H.

As the current levels in the non-linear current amplifier increase, however, the potential drop across R2 increases, decreasing $V_{BEQ4}$ relative to $V_{BEQ3}$ and consequently decreasing the collector current $I_{CQ4}$ of Q4 relative to $I_{CQ3}$. Therefore, the current gain of the non-linear current amplifier as between its input connection to T4 and its output connection to T3 will be reduced as the current applied to its input connection increases. In the FIG. 1 circuit the non-linear current amplifier is in regenerative loop connection with a current mirror amplifier having a current gain of −G and has a low-level current gain −H greater than −(1/G). Once conduction of currents between the output circuit of each of these amplifiers and the input circuit of each other of these amplifiers is initiated, these currents will grow until the gain of the non-linear current amplifier is reduced to −(1/G), and open-loop gain is stablized at unity.

Regenerative loop configuration as thus far described can be analyzed proceeding from the following basic equation describing transistor operation.

$$V_{BEQX}=(kT_{QX}/q)\ \ln\ (I_{EQX}/A_{QX}J_S)$$

where $V_{BEQX}$ is the emitter-to-base potential of a transistor $Q_X$, $T_{QX}$ its operating temperature, $I_{EQX}$ its current, $A_{QX}$ the effective area of its emitter-base junction, k is Boltzmann's constant, q is the charge of an electron, and $J_S$ is the density of current flow through an unbiased emitter-base junction of unit effective area.

Such analysis has determined that these regenerative loop configurations stabilize with the potential drop $V_{R2}$ across resistor R2 assuming the following value, where R2 is the resistance of resistor R2.

$$V_{R2}=(kT/q)\ \ln\ G$$

Since in the stable condition of the regenerative loop the current flowing through the output circuit of the current mirror amplifier and the input circuit of the non-linear current amplifier is G times as large as the current flowing through the output circuit of the non-linear current amplifier and the input circuit of the current mirror amplifier, the current flowing through terminal T2 and thence through resistor R1 will be (G+1) times the current flowing across R1.

By simple scaling, then, one can determine the voltage drop $V_{R1}$ across resistor R1, having a resistance $R_1$, to be as follows.

$$V_{R1}=(G+1)\ (R_1/R_2)\ (kT/q)\ \ln\ G$$

One can choose G, $R_1$ and $R_2$ such that the positive-temperature-coefficient $V_{R1}$ potential drop will augment the negative temperature-coefficient $V_{BEQ3}$ to provide at the interconnected base electrodes of Q3 and Q4 a zero-temperature-coefficient voltage equal to the extrapolated band-gap voltage $V_{g0}$ of the semiconductor material from which Q3 and Q4 are made (1.206 v. for silicon transistors). Also, if the means direct coupling the collector of Q3 to its base includes a potential divider PD1 applying divided potential equal to $V_{g0}$ from its output to the interconnected base electrodes of Q3 and Q4, the undivided potential applied to the input of the potential divider PD1 will be larger than $V_{g0}$ by a factor equal to the factor by which the divider divides the potential applied to its input. That is, in the FIG. 1 circuit, where potential divider PD1 comprises serially connected resistors R3 and R4 having respective resistance $R_3$ and $R_4$, the potential at terminal $T_5$ is regulated to a value $[(R_4/R_3)+1]\ V_{g0}$.

One of the synergistic effects in the FIG. 1 circuit, which is of primary interest with regard to the present invention, concerns the direct-coupled collector-to-base feedback for transistor Q3 being carried forward such that the potentials at terminals T3 and T4 are made equal. Since the emitter potentials of Q3 and Q4 differ by only a few millivolts this makes their respective emitter-to-collector potentials $V_{CEQ3}$ and $V_{CEQ4}$ substantially equal, which improves the tracking of their $I_C$-versus-$V_{BE}$ characteristics. (The emitter-to-collector potentials of Q3 and Q4 can be made still more closely equal by inserting a resistor between terminal T4 and the collector of Q3 of resistive value $R_2/G$.) More importantly, since the source potentials of Q1 and Q2 are alike, equalization of the potentials at T3 and T4 makes their respective source-to-drain potentials $V_{DSQ1}$ and $V_{DSQ2}$ equal.

The $I_{DS}$-versus-$V_{GS}$ characteristics of field effect transistors can be appreciably affected by their $V_{DS}$'s, so a predictable current gain of −G from the current mirror amplifier connection of Q1 and Q2 can be better assured by regulating $V_{DSQ2}$ to equal $V_{DSQ1}$. When the self-balancing bridge network is to be subjected to higher operating temperatures, Q1 and Q2 are preferably field effect transistors (FET's) rather than lateral-structure PNP transistors, despite the pronounced effect the potentials across the principal current conducting paths of FET's have upon their output current versus input voltage characteristics (i.e., their $I_{DS}$ versus $V_{GS}$ characteristics). At such temperatures the tracking of the $I_C$-versus-$V_{BE}$ characteristics of lateral transistors exhibits some inaccuracies, theorized as being attributable to differences in the action of parasitic transistors to substrate associated with the lateral PNP transistor structures.

Since terminal T3 is held at a predetermined potential—i.e., the potential at T1 reduced by $V_{GSQ1}$—the potential at T4 remains to be regulated if the potentials at T3 and T4 are to be equalized. As pointed out above, Q3 is to be provided direct-coupled collector-to-base feedback for conditioning it to demand the current supplied to terminal T4 from the drain of Q2. Suppose that one views the FIG. 1 circuit as a bridge network for voltage with an output port between terminals T3 and T4, and that one considers it as a bridge network for current with an output terminal at T4 insofar as the balancing of the collector current demanded by Q3 with the drain current supplied by Q2. One can then discern that balance of both bridge network conditions can be achieved simultaneously using a differential-input amplifier having an inverting input connection at T4, an non-inverting input connection at T3, and its output connection direct coupled to the interconnection between the base electrodes of Q3 and Q4. This can be achieved so long as there is no substantial input offset error voltage between the inverting and non-inverting input connections of the differential-input amplifier when its output connection supplies the forward bias to the interconnected base electrodes of Q3 and Q4 that is, in essence, that which is required to balance the collector current demanded by Q3 and the drain current supplied by Q2.

In the FIG. 1 circuit this differential-input amplifier includes PNP transistors Q5 and Q6 connected in long-tailed pair configuration to receive a tail current $I_T$ at the interconnection of their emitter electrodes. If Q3 demands a collector current less than the drain current supplied by Q2, which as indicated above occurs at lower levels of current in the FIG. 1 circuit, Q6 will be biased into reduced conduction, increasing the portion of $I_T$ conducted by Q5. This increases the collector current $I_{CQ5}$ of Q5 applied as base current $I_{BQ7}$ to an NPN transistor Q7 to draw Q7 into increased conduction. The resulting increase in the emitter current $I_{EQ7}$ of Q7 increases the potential drop across serially connected resistors R4 and R3 in potential divider PD, raising in proportion the potentials at terminal T5 and at the interconnection of the base electrodes of Q3 and Q4, to increase the collector current $I_{CQ3}$ demanded by Q3. This process halts only when ICQ3 demanded by Q3 equals the drain current $I_{DSQ2}$ supplied by Q2, plus the relatively small base current $I_{BQ6}$ which must be demanded from Q6.

The potential difference between terminals T3 and T4 will be relatively small when this balancing of current supply and demand is achieved for any sufficiently large value of $I_T$. However, in an elegant design following the example of FIG. 1, $I_T$ will be provided at such value that the potential difference between terminals T3 and T4 will be essentially zero for the balance condition. Now, the balance condition obtains when $I_{EQ7}$ reaches a prescribed value $I_{EQ7BAL}$ such that the potential drop across R3 biases Q3 and Q4 into appropriate degrees of forward conduction. Assume Q7 and another NPN transistor Q8 to have common-emitter forward current gains $h_{feNPN}$. Then, to support its emitter current $I_{EQ7BAL}$ transistor Q7 must be supplied a base current $I_{BQ7BAL}=I_{EQ7BAL}/(h_{feNPN}+1)$. So when the balance condition obtains the collector current $I_{EQ5}$ of Q5 will have a value $I_{CQ5BAL}=I_{EQ7BAL}/(h_{feNPN}+1)$. Any collector current $I_{CQ5}$ provided by Q5 requires for its support an emitter current $I_{EQ5}$ of the same value plus a little bit to account for base current flow, so $I_{EQ5}$ under balance condition will assume a value substantially equal to $I_{EQ7BAL}/h_{feNPN}$.

Q7 will demand a collector current $I_{CQ7}$ that is $[h_{feNPN}/(h_{feNPN}+1)]$ times its emitter current $I_{EQ7}$ as the emitter current $I_{EQ8}$ of Q8, which is supported by a base current $I_{BQ8}$ for Q8 to equal to $I_{EQ7}/(h_{feNPN}+1)$. $I_{BQ8}$ is withdrawn from the input circuit of a current mirror amplifier having a current gain substantially equal to $-(G+1)$.

This current mirror amplifier comprises a PNP master mirroring transistor Q9 and a PNP slave mirroring transistor Q10 having $I_C$-versus-$V_{BE}$ characteristics in 1:(G+1) ratio at all values of $V_{BE}$, as symbolized by the encircled "1" and "(G+1)" near their respective emitter electrodes. So disregarding base current errors Q10 supplies a collector current substantially equal to $(G+1)\ I_{EQ7}/(h_{feNPN}+1)$ as the tail current $I_T$.

Since $h_{feNPN}$ is presumed to be much larger than unity, $I_T$ closely approximates $(G+1)I_{EQ7}/h_{feNPN}$ and will have a value close to $(G+1)I_{EQ7BAL}/h_{feNPN}$ for balance condition. This tail current supplies Q5 its emitter current $I_{EQ5}$ substantially equal to $I_{EQ7BAL}$ $(h_{feNPN})$ for balance condition, the remaining $GI_{EQ7BAL}/h_{feNPN}$ portion of $I_T$ flowing as emitter current $I_{EQ6}$ to Q6. So for balance condition the respective emitter currents $I_{EQ5}$ and $I_{EQ6}$ of Q5 and Q6 will essentially be in 1:G ratio.

Q5 and Q6 have respective $I_E$-versus-$V_{BE}$ characteristics in 1:G ratio for all values of $V_{BE}$ as symbolized by the encircled "1" and "G" near their respective emitter electrodes. So under conditions where their emitter currents $I_{EQ5}$ and $I_{EQ6}$ are in 1:G ratio, Q5 and Q6 will have respective emitter-to-base offset voltages $V_{BEQ5}$ and $V_{BEQ6}$ which are equal. So, the $V_{BEQ5}$ offset of the interconnected emitter electrodes of Q5 and Q6 from the potential at terminal T3 and the base electrode of Q5 is compensated for by their $V_{BEQ6}$ offset from the potential at terminal T4 and the base electrode of Q6, and terminals T3 and T4 are at substantially the same potential.

The differential-input amplifier described above where the tail current supplied to Q5 and Q6 is controlled to equalize their conduction can be employed in reference voltage circuits like that shown in FIG. 1 except for Q1 and Q2 being replaced by resistors with respective conductances in 1:G ratio being used to connect terminal T1 to terminal T3 and to terminal T4, respectively. Such an arrangement is less satisfactory, however, since to operate with the current levels afforded by Q1 and Q2 while at the same time obtaining the high impedance level afforded by Q2 operating as a constant current generator, one would have to operate with a much higher energizing potential from supply VS. Also, in an integrated circuit construction one would have to integrate two large-area resistors.

The base current of NPN transistor Q11 is used as a starting current to initiate conduction in the regenerative loop connection of the current mirror amplifier that includes Q1 and Q2 with the non-linear current amplifier that includes Q3 and Q4. To keep this current negligibly small relative to the current flowing between Q1 and Q4 for the balance condition, Q11 is provided substantial emitter degeneration by resistor R5, indicated to be a "pinch" or doubly diffused resistor by the line beside the conventional resistor symbol.

Figure 2:
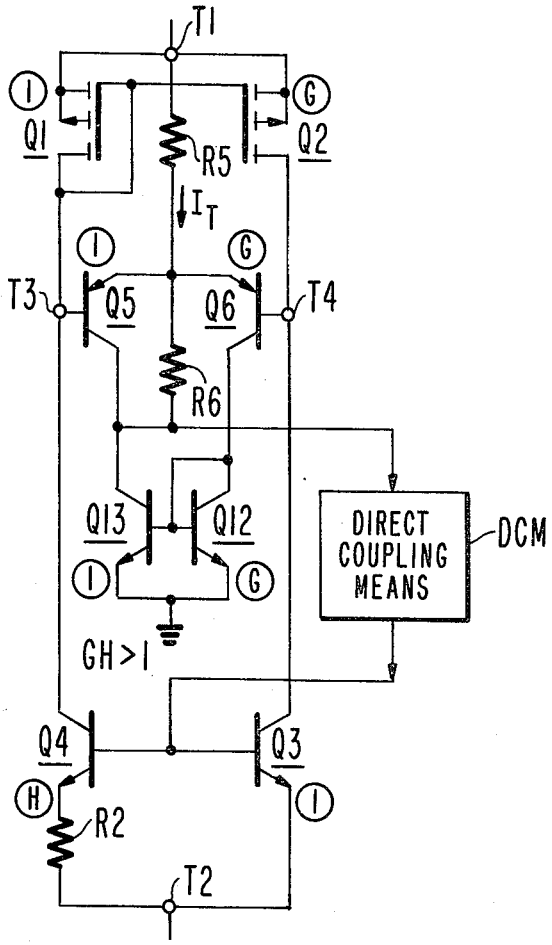
FIG. 2 is a schematic diagram of a self-biasing bridge network embodying the present invention.

FIG. 2 shows a self-balancing bridge network in which the differential-input amplifier used to sense the difference between the drain current of Q2 and collector current of Q3, while minimizing the voltage difference between terminals T3 and T4, is somewhat different from that in FIG. 1, permitting more flexibility in the choice of direct coupling means DCM used to direct couple the collector of Q5 to the interconnection between the base electrodes of Q3 and Q4. The tail current $I_T$ supplied to the joined emitter electrodes of Q3 and Q4 is made substantially larger than the error signal which must be supplied to the input of the direct coupling means DCM. The collector current of Q6 instead of being routed directly to ground is routed thereto through the input circuit of a current mirror amplifier, the output circuit of which connects the collector of Q5 to ground.

This current mirror amplifier, which provides balanced to single-ended signal conversion of the collector currents of Q5 and Q6, is shown as being of a typical construction. It includes NPN mirroring transistors Q12 and Q13. The master mirroring transistor Q12 is provided with direct-coupled collector-to-base feedback that adjusts its emitter-to-base voltage $V_{BEQ12}$ for conditioning it to conduct as collector current $I_{CQ12}$ all the collector current $I_{CQ6}$ of Q6 except for those small portions used to supply base currents to Q12 and Q13. The slave mirroring transistor Q13 has $V_{BEQ12}$ applied to it as its emitter-to-base voltage $V_{BEQ13}$ conditioning it to conduct a collector current $I_{CQ13}$ (1/G) times as large as $I_{CQ12}$, sinking all of the collector current $I_{CQ5}$ of Q5 except for the error current supplied to the direct coupling means DCM, which error current normally is comparatively very small.

One may, for example, wish to make the direct coupling means DCM a direct connection without substantial intervening impedance in applications where the self-balancing bridge network is to be used simply as a two-terminal current regulator. One might desire this also in applications where T1 and T2 are directly connected without substantial intervening impedance to the terminals of an energizing potential supply, and where at least one of the transistors Q1, Q2, Q3 and Q4 has its input circuit parallelled with that of an auxiliary transistor, thereby conditioning the auxiliary transistor to provide constant current generator action in its output circuit.

One also has more flexibility with regard to the design of the source of tail current $I_T$ with the FIG. 2 differential-input amplifier. In FIG. 2 the tail curent $I_T$ is simply developed in accordance with Ohm's law by applying the source-to-gate potential of Q1 less the emitter-to-base voltage of Q5 as regulated voltage across a resistor R5.

Resistor R6 is a relatively high-value resistance used for starting current flow in the regenerative loop by drawing Q1, Q2, Q3 and Q4 into low-level conduction. Under balance conditions when Q5 is substantially more conductive than resistor R6 parallelling its principal conduction path, R6 will have inconsequential effect upon circuit operation.

Figure 3:
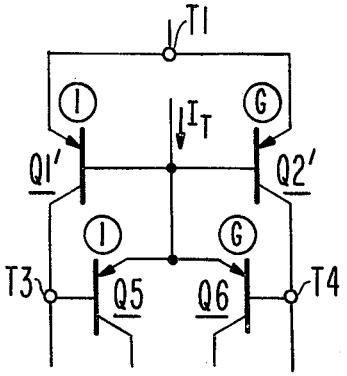
FIGS. 3, 4 and 5 are schematic diagrams of modifications that can be made to either of the FIGS. 1 and 2 circuits providing for further embodiments of the present invention.

The use of circuits similar to those shown in FIGS. 1 and 2 except for p-channel field effect transistors Q1 and Q2 being replaced by bipolar PNP transistors Q1′ and Q2′ is possible, but their combined base currents flow through Q4 and not through Q3, creating an error in the tracking of the relative degrees of conduction of Q3 and Q4. This problem can be alleviated by the connection shown in FIG. 3 which is a sort described per se by C. F. Wheatley, Jr. in U.S. Pat. No. 3,614,645 issued Oct. 19, 1971 and entitled DIFFERENTIAL AMPLIFIER. The base emitter junction of Q5 is included in the direct-coupled collector-to-base feedback connection of transistor Q1′. The combined base currents of Q1′ and Q2′ flow as a portion of the tail current $I_T$ and are apportioned in 1:G ratio by the current splitting action of emitter-coupled transistors Q5 and Q6, so they have no substantial differential effect on the potentials at terminals T3 and T4.

Figure 4:
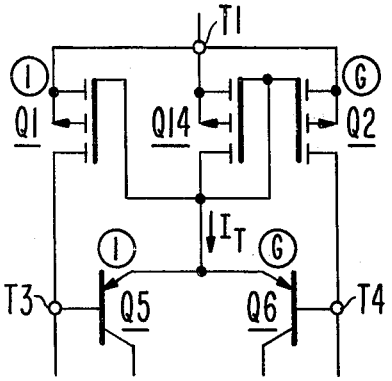

The Wheatley, Jr. connection is also useful in modifications of the FIG. 2 self-balancing bridge networks when one wishes to exploit the regulated emitter-to-base potentials of Q1′ and Q2′ in generating tail current $I_T$ by means of a self-biased transistor connected between terminal T1 and the interconnected emitter electrodes of Q5 and Q6. FIG. 4 shows this technique put to use with FET's Q1 and Q2 and a self-biased FET Q14.

Figure 5:
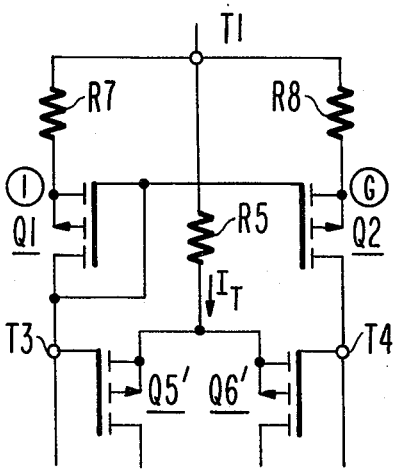

The Wheatley, Jr. connection tends to take up a substantial amount of available energizing potential, however, when Q5 and Q6 are replaced by enhancement-mode p-channel FETs Q5′ and Q6′ as shown in FIG. 5. In such circumstances one may choose to exclude Q5′ from the drain-to-gate feedback of Q1. Potential dropping resistors R7 and R8 with respective resistances R7 and R8 in G:1 ratio may be used as source degeneration resistors for Q1 and Q2, respectively, to apply a potential drop across R5 for causing tail current $I_T$ to flow therethrough. Alternatively, where the source electrodes of Q1 and Q2 connect directly without substantial intervening impedance to terminal T1, a potential offsetting element can be introduced into the drain-to-gate feedback connection of Q1. This leads one back to the possibility of using the Wheatly, Jr. connection but negatively offsetting the interconnected gates of Q1 and Q2 from the interconnected source electrodes of Q5′ and Q6′.

Figure 6:
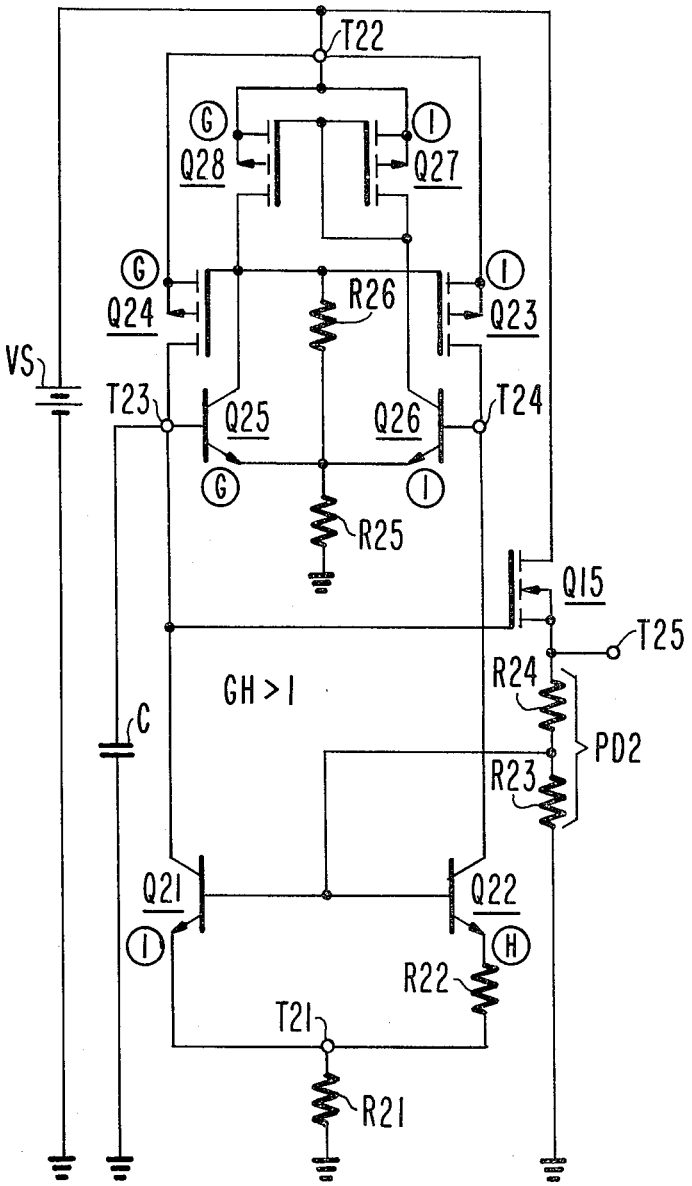
FIGS. 6, 7 and 8 are schematic diagrams of further voltage supplies including self-balancing bridge networks, each of which embodies the present invention.

FIG. 6 shows how the differential-input amplifier may be incorporated into the current mirror amplifier portion of the circuit rather than into the non-linear current amplifier portion. The input port of the bridge network is between first and second terminals T21 and T22, and its output port is between third and fourth terminals T23 and T24. T22 is connected to the positive pole of a source VS of energizing potential. T21 is connected via a resistor R21 to the negative pole of source VS, shown as being grounded.

The non-linear current amplifier has its input, output and common connections at terminals T23, T24 and T21, respectively, It includes first and second transistors Q21 and Q22 which are NPN bipolar transistors which would have emitter-to-collector currents in 1:H ratio at all levels, if their emitter-to-base potentials were equal, as symbolized by the encircled "1" and "H" near their respective emitter electrodes. The emitter electrode of Q21 connects directly without substantial intervening impedance to terminal T21, and the emitter electrode of Q22 connects via a resistor R22 to terminal 21. Q21 is provided via n-channel source-follower field effect transistor Q15 and potential divider PD2, direct-coupled collector-to-base feedback, that adjusts its emitter-to-base potential $V_{BEQ25}$. $V_{BEQ25}$ is adjusted to condition the collector current demand $I_{CQ25}$ of $Q_{25}$ to be essentially equal to input current applied to terminal T23 at the input connection of the non-linear current amplifier—equal, that is, except for the negligibly small base current $I_{BQ25}$ of Q25.

The base potential of Q21 is applied as base potential to Q22, so at very low current levels, where the potential drop across R22 is negligibly small, the emitter-to-base potential $V_{BEQ22}$ of Q22 will be substantially equal to $V_{BEQ25}$. Consequently, the collector current demand $I_{CQ22}$ of Q22 will be H times $I_{CQ21}$, and the low-level current gain of the non-linear current amplifier will be −H. At higher current levels the drop across R22 will degenerate the common-emitter forward current gain of Q22 reducing the proportionality between its conduction and that of Q21 to 1/G and thus the current gain of the non-linear current amplifier to (1/G), −G being the current gain of the current mirror amplifier with which the non-linear current amplifier is connected in regenerative feedback loop. That is, growth of the currents in the amplifiers connected in this regenerative feedback loop is curtailed when loop current gain is reduced to unity.

By analogy to the FIG. 1 reference voltage circuit this occurs when the potential drop $V_{R22}$ across R22 and the potential drop $V_{R21}$ across R21 reach the following values.

$$V_{R22}=(kt/q)\ \ln G$$

$$V_{R21}=(G+1)(R_{21}/R_{22})(kt/q)\ \ln G$$

$R_1$, $R_2$ and G can be so chosen such that $V_{gO}$ appears at the interconnected base electrodes of Q21 and Q21—i.e., at the output of the potential divider PD2. The direct coupled collector-to-base feedback of Q21 via source-follower Q15 and potential divider PD2 then causes the output voltage $V_{25}$ at terminal T25 to be $V_{gO}$ multiplied by the potential division factor between the input and output of PD2. With PD2 a resistive potential divider comprising serially connected resistors R23 and R24, as shown in FIG. 6, with respective resistances $R_{23}$ and $R_{24}$—the output voltage $V_{25}$ at terminal 25 will have a value $[(R_{24}/R_{23})+1]\ V_{gO}$.

The current mirror amplifier having input, output and common connections at terminals T24, T23 and T22, respectively, takes a form similar to that described by A.A.A. Ahmed in U.S. Pat. No. 4,068,184 patented Jan. 10, 1978 and entitled "CURRENT MIRROR AMPLIFIER". Third and fourth transistors Q23 and Q24 are enhancement-mode p-channel insulated-gate field effect transistors having respective conductances in 1:G ratio for all levels of their similar respective source-to-gate potentials $V_{GSQ23}$ and $V_{GSQ24}$, where G is a positive constant, as symbolized by the encircled "1" and "G" near their respective source electrodes. Q23 and Q24 are the master and slave mirroring transistors, respectively, Q23 being provided direct coupled drain-to-gate feedback to condition its source-to-drain path to conduct input current demanded at terminal T24, at the input connection of the current mirror amplifier.

This direct coupled feedback is provided by the long-tailed pair configuration of NPN bipolar transistors Q25 and Q26, the collector currents of which are differentially combined by a subordinate current mirror amplifier connection of p-channel enhancement-mode insulated gate field effect transistors Q27 and Q28. Resistor R25 withdraws tail current from the interconnection of the emitter electrodes of Q25 and Q26, and resistor R26 is used to start conduction in the regenerative loop connection of non-linear current amplifier and current mirror amplifier. A capacitor C may be connected at terminal T23 to stabilize the reference circuit against regenerative effects at higher frequencies.

Figure 7:
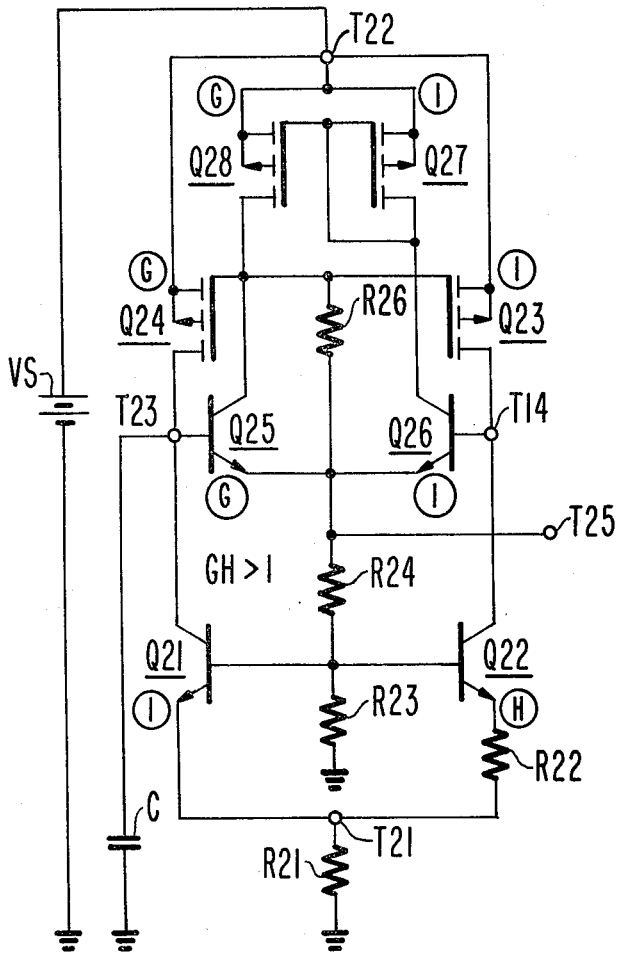

FIG. 7 shows a modification of the FIG. 6 circuit in which the emitter-follower action of Q25 is used to drive the input of potential divider PD2, rather than the source-follower action of Q15. The serially connected resistors R23 and R24, rather than R25, withdraw tail current from the interconnection of the emitter electrodes of Q25 and Q26. Note this current flow is apportioned between the emitters of Q25 and Q26, so the effect of the base current demand of Q25 at terminal T23 upon the balance of the bridge network is compensated for by the effect of the base current demand of Q26 at terminal T14. This compensation would not obtain if the source-follower FET Q15 were simply replaced by an emitter-follower NPN bipolar transistor Q15'.

Figure 8:
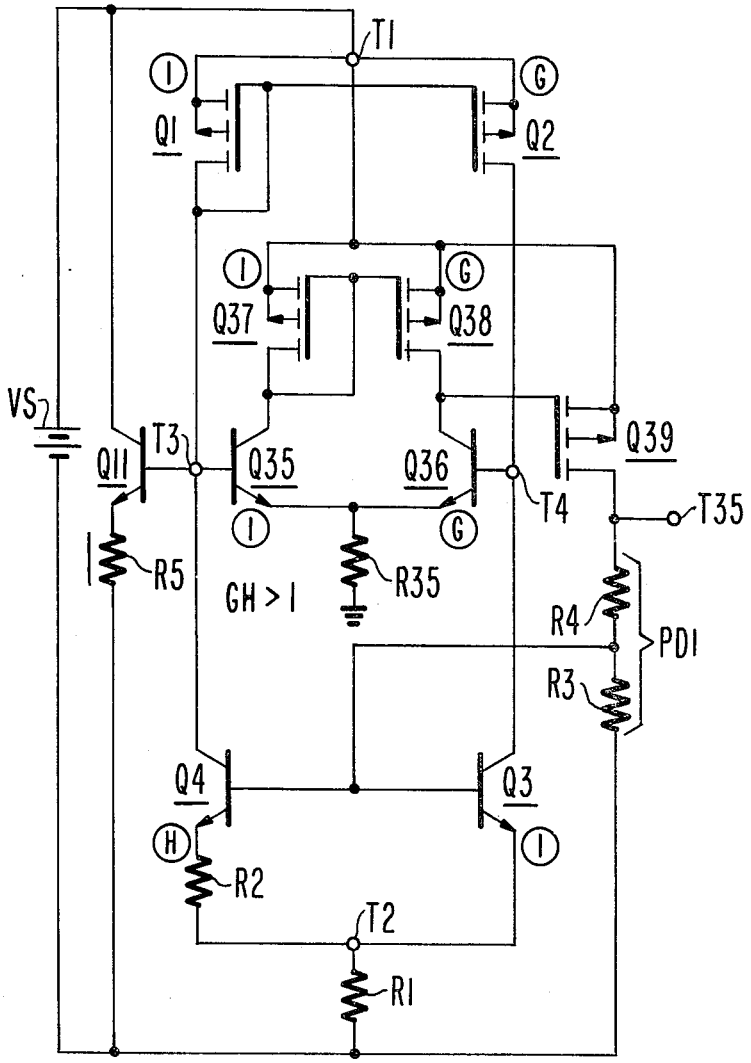

FIG. 8 shows a modification of the FIG. 1 reference voltage circuit which uses a different sort of differential-input amplifier with inverting and non-inverting input connections at terminals T3 and T4, respectively, and with output connection direct coupled via potential divider PD1 to the interconnection between the base electrodes of Q3 and Q4. The differential-input amplifier of FIG. 8 requires no lateral-structure PNP bipolar transistors, replacing them with NPN bipolar transistors Q35 and Q36. Q35 and Q36 are in long-tailed-pair configuration with tail current withdrawn from the interconnection of their emitter electrodes via resistor R35. Their collector currents are differentially combined to develop an error signal in a current mirror amplifier including p-channel enhancement-mode insulated-gate field effect transistors Q37 and Q38 as its master mirroring transistor and its slave mirroring transistor, respectively. This error signal is applied to the gate p-channel enhancement-mode insulated-gate field effect electrode of common-source-amplifier transistor Q39, having the input circuit of potential divider PD1 as its drain load, developing a reference voltage at terminal T35. Besides avoiding the use of PNP bipolar transistors which may be difficult to integrate, except with lateral structures that exhibit limited bandwidth, this configuration can provide a regulated output voltage that can range upward to its supply voltage; and that supply voltage can be reduced to $V_{gO}$ plus $V_{GS}$ of a p-channel FET. Tendency towards self-oscillation can be suppressed by connecting a by-pass capacitor between terminal T35 and the negative pole of supply VS.

Armed with the foregoing disclosure one skilled in the arts of electronic design can readily formulate other embodiments of the present invention. For example, the simple first, second, third, and fourth transistors used in the bridge network can be replaced by compounded transistor structures such as Darlington cascade connections or cascode arrangements of transistors. The ensuing claims should be interpreted liberally to include within their scope such variants upon the described embodiments of the invention as would naturally be considered by those skilled in the art of designing electronic circuits, particularly those skilled in the art of designing circuits using self-balancing bridge networks.

In the claims a galvanic connecting means is one which is capable of conducting both direct and changing components of current and may merely consist of a direct, impedance-free connection, for example.

What is claimed is:

1. A current amplifier comprising:

input, output and common terminals;

first and second bipolar transistors of a first conductivity type, having respective collector electrodes respectively connected to said input terminal and to said output terminal, having respective emitter electrodes connected to said common terminal, and having respective base electrodes with an interconnection therebetween through which the combined base currents of said first and second transistors flow;

third and fourth transistors of a second conductivity type complementary to said first conductivity type, having respective input electrodes respectively connected to said input terminal and to said output terminal, having respective output electrodes respectively connected to said common terminal and direct coupled to said interconnection between the base electrodes of said first and second transistors, and having respective common electrodes; and means for completing the connection of said third and fourth transistors in long-tailed-pair configuration including means responsive to the combined base currents of said first and second transistors for applying a tail current to an interconnection between the common electrodes of said third and fourth transistors which is in such proportion to those combined base currents as to maintain the potential offset between said input and output terminals substantially zero.

2. A self-balancing bridge network comprising:

first and second terminals defining an input port for connection to an energizing supply;

third and fourth terminals defining an output port;

first and second conductive means connecting said first terminal respectively to said third terminal and to said fourth terminal and having conductances in 1:G ratio, G being a positive number;

first and second transistors of a first conductivity type, each of them having respective first and second electrodes defining the ends of its principal current conduction path and having a respective third electrode, the conduction of its principal current conduction path being controlled by potential appearing between its first and third electrodes, the conduction of the principal current conduction path of said first transistor being H times that of said second transistor for any given value of first-to-third electrode potential, H being a positive number which multiplied by G exceeds unity, the second electrodes of said first and second transistors being galvanically connected respectively to said third terminal and to said fourth terminal;

a resistor having a first end connected to the first electrode of said first transistor and having a second end connected to the first electrode of said second transistor and to said second terminal;

third and fourth current-amplifying transistors of said first conductivity type, each of said transistors having first and second electrodes defining the ends of its principal current conduction path and having a respective third electrode, the conduction of its principal current conduction path being controlled by current applied to its third electrode, the current amplification between the third electrode and the principal current conduction path of each of said third and fourth transistors being substantially equal to that of the other;

means direct coupling the first electrode of said third transistor to an interconnection between the third electrodes of said first and second transistors;

means for galvanically connecting the second electrode of said third transistor to the first electrode of said fourth transistor;

means for applying operating potential to the second electrode of said fourth transistor;

current mirror amplifier means having an input connection to the third electrode of said fourth transistor and having an output connection for supplying a current G+1 times as great as the current demanded at its input connection;

fifth and sixth transistors of a second conductivity type complementary to said first conductivity type, each of these transistors having respective first and second electrodes defining the ends of its principal current conduction path and having a respective third electrode, the conduction of its principal current conduction path being controlled by potential appearing between its first and third electrodes, the conduction of the principal current conduction path of said sixth transistor being G times as large as that of said fifth transistor for any given value of first-to-third electrode potential, the first electrodes of said fifth and sixth transistors being connected together at an interconnection to receive current from the output connection of said current mirror amplifier means, the third electrodes of said fifth and sixth transistors respectively being at said third terminal and at said fourth terminal;

means for applying operating potential to the second electrode of said sixth transistor; such that current through that electrode does not flow to affect voltage at, or current to, the third electrode of said third transistor; and means for galvanically connecting the second electrode of said fifth transistor to the third electrode of said third transistor, so the currents flowing through these electrodes are the same.

3. A self-balancing bridge network as set forth in claim 2 including:

seventh and eight transistors of said second conductivity type each of them having respective first and second electrodes defining the ends of its principal current conduction path and having a respective third electrode, the conduction of its principal current conduction path being controlled by potential appearing between its first and third electrodes, the conduction of the principal conduction path of said eighth transistor being G times as large as that of said seventh transistor;

means for operating the principal conduction path of said seventh transistor as said first conductive means, including respective connections of the first and second electrodes of said seventh transistor to said first terminal and to said third terminal, and including means for providing a direct coupled feedback connection from the second electrode of said seventh transistor to its third electrode; and means for operating the principal conduction path of said eighth transistor as said second conductive means, including respective connections of the first and second electrodes of said eighth transistor to said first terminal and to said fourth terminal and including means for applying the same potential to the third electrode of said eighth transistor as to the third electrode of said seventh transistor.

4. A self-balancing bridge network as set forth in claim 2 including:

seventh and eighth transistors of said second conductivity type each of them having respective first and second electrodes defining the ends of its principal current conduction path and having a respective third electrode, the conduction of its principal current conduction path being controlled by potential appearing between its first and third electrodes, the conduction of the principal conduction path of said eighth transistor being G times as large as that of said seventh transistor;

means for operating the principal conduction path of said seventh transistor as said first conductive means, including respective connections of the first and second electrodes of said seventh transistor to said first terminal and to said third terminal, and including a connection from the interconnection between the first electrodes of said fifth and sixth transistors to the third electrode of said seventh transistor; and means for operating the principal conduction path of said eighth transistor as said second conductive means, including respective connections of the first and second electrodes of said eighth transistor to said first terminal and to said fourth terminal and including a connection from the interconnection between the first electrodes of said fifth and sixth transistors to the third electrode of said eighth transistor.

5. A self-balancing bridge network comprising:

first and second terminals defining an input port for connection to an energizing supply;

third and fourth terminals defining an output port;

first and second transistors of a first conductivity type and third and fourth transistors of a second conductivity type complementary to the first conductivity type, each of said transistors having respective first and second electrodes defining the ends of its principal current conduction path and having a respective third electrode, the conduction of its principal current path being controlled by potential appearing between its first and third electrodes;

means for connecting said first and second transistors as a first current amplifier having an input connection at said third terminal, having a common connection at said first terminal, and having an output connection at said fourth terminal, said means including first and second galvanic connecting means between said first terminal and the first electrodes respectively of said first transistor and of said second transistor, third galvanic connecting means between the second electrode of said first transistor and said third terminal, fourth galvanic connecting means between the second electrode of said second transistor and said fourth terminal, and means exclusive of said fourth galvanic connecting means, directly responsive to the potential at said third terminal for controlling the potentials at the third electrodes of said first and second transistors, thereby completing a direct coupled voltage feedback connection between the second and third electrodes of said first transistor;

means for connecting said third and fourth transistors as a second current amplifier having an input connection at said fourth terminal, having a common connection at said second terminal, and having an output connection at said third terminal, including fifth and sixth galvanic connecting means between said second terminal and the first electrodes respectively of said third transistor and of said fourth transistor, seventh galvanic connecting means between the second electrode of said third transistor and said fourth terminal, eighth galvanic connecting means between the second electrode of said fourth transistor and said third terminal, and differential-input amplifier means having inverting and non-inverting input connections respectively at said third and fourth terminals and having an output connection for directly controlling the potentials at the third electrodes of said third and fourth transistors; and current feedback means included in at least the second of said first and second current amplifiers to differentially degenerate the gains of its said transistors for reducing the product of the current gains of said first and second current amplifiers.

6. A self-balancing bridge network as set forth in claim 5 wherein said differential-input amplifier means includes:

fifth and sixth transistors, each having respective first and second electrodes defining the ends of its principal current conduction path and having a respective third electrode, the conduction of its principal current conduction path being controlled by potential appearing between its first and third electrodes, the inverting and non-inverting input connections of said differential-input amplifier respectively being at the third electrode of said fifth transistor and at the third electrode of said sixth transistor;

means for completing connection of said fifth and sixth transistors in long-tailed-pair configuration including means for direct coupling the collector electrode of said fifth transistor to the output connection of said differential-input amplifier; and means for applying tail current to an interconnection of the first electrodes of said fifth and sixth transistors.

7. A self-balancing bridge network as set forth in claim 6 including a current mirror amplifier having an input connection to which the second electrode of said sixth transistor connects and having an output connection to the output connection of said differential input amplifier.

8. A self-balancing bridge network as set forth in claim 6 wherein fifth and sixth transistors are of said first conductivity type.

9. A self-balancing bridge network comprising:

first and second terminals defining an input port for connection to an energizing supply;

third and fourth terminals defining an output port;

first and second transistors of a first conductivity type and third and fourth transistors of a second conductivity type complementary to the first conductivity type, each of said transistors having respective first and second electrodes fifth and sixth galvanic connecting means between said second terminal and the first electrodes respectively of said third transistor and of said fourth transistor, seventh galvanic connecting means between the second electrode of said third transistor and said fourth terminal, eighth galvanic connecting means between the second electrode of said fourth transistor and said third terminal, fifth and sixth transistors of a conductivity type complementary to said first conductivity type, each having respective first and second electrodes defining the ends of its principal current conduction path and having a respective third electrode, the conduction of its principal current conduction path being controlled by potential appearing between its first and third electrodes, the third electrode of said fifth transistor having said third terminal connected thereto the third electrode of said sixth transistor having said fourth terminal connected thereto, and the second electrode of said fifth transistor being direct coupled to the third electrodes of said third and fourth transistors for controlling their potentials, and means for completing connection of said fifth and sixth transistors in long-tailed-pair configuration including means for connecting the second electrode of said sixth transistor to said first terminal and means for applying tail current to an interconnection of the first electrodes of said fifth and sixth transistors; and current feedback means included in at least one of said first and second current amplifiers to differentially degenerate the gains of its said transistors for reducing the product of the current gains of said first and second current amplifiers.

10. A self-balancing bridge network comprising:

first and second terminals defining an input port for connection to an energizing supply;

third and fourth terminals defining an output port;

first and second transistors of a first conductivity type and third and fourth transistors of a second conductivity type complementary to the first conductivity type, each of said transistors having respective first and second electrodes defining the ends of its principal current conduction path and having a respective third electrode, the conduction of its principal current path being controlled by potential appearing between its first and third electrodes;

means for connecting said first and second transistors as a first current amplifier having an input connection at said third terminal, having a common connection at said first terminal, and having an output connection at said fourth terminal, said means including first and second galvanic connecting means between said first terminal and the first electrodes respectively of said first transistor and of said second transistor, third galvanic connecting means between the second electrode of said first transistor and said third terminal, fourth galvanic connecting means between the second electrode of said second transistor and said fourth terminal, and means exclusive of said fourth galvanic connecting means, directly responsive to the potential at said third terminal for controlling the potentials at the third electrodes of said first and second transistors, thereby completing a direct-coupled voltage feedback connection between the second and third electrodes of said first transistor;

means for connecting said third and fourth transistors as a second current amplifier having an input connection at said fourth terminal, having a common connection at said second terminal, and having an output connection at said third terminal, including fifth and sixth galvanic connecting means between said second terminal and the first electrodes respectively of said third transistor and of said fourth transistor, seventh galvanic connecting means between the second electrode of said third transistor and said fourth terminal, eighth galvanic connecting means between the second electrode of said fourth transistor and said third terminal, and differential-input amplifier means having inverting and non-inverting input connections respectively at said third and fourth terminals and having an output connection for directly controlling the potentials at the third electrodes of said third and fourth transistors; and current feedback means included in at least one of said first and second current amplifiers to differentially degenerate the gains of its said transistors for reducing the product of the current gains of said first and second current amplifiers—said self-balancing bridge network being improved in that said differential-input amplifier means includes:

fifth and sixth transistors, each having respective first and second electrodes defining the ends of its principal current conduction path and having a respective third electrode, the conduction of its principal current conduction path being controlled by potential appearing between its first and third electrodes, the inverting and non-inverting input connections of said differential-input amplifier respectively being at the third electrode of said fifth transistor and at the third electrode of said sixth transistor; and means for completing connection of said fifth and sixth transistors in long-tailed-pair configuration including means for applying tail current to an interconnection of the first electrodes of said fifth and sixth transistors, and including a current mirror amplifier having an input connection to which the second electrode of said sixth transistor connects and having an output connection to the output connection of said differential input amplifier.

11. A self-balancing bridge network as set forth in claim 10 wherein fifth and sixth transistors are of said first conductivity type.

12. A self-balancing bridge network as set forth in claim 10 or 11 wherein said means directly responsive to the potential at said third terminal for controlling the potentials of said first and second transistors comprises the potential follower action of said fifth transistor as provided between its third electrode and its first electrode and means for applying to an interconnection between the third electrodes of said first and second transistors at least a portion of the potential appearing between said first terminal and the first electrode of said fifth transistor;

wherein said current feedback means includes a first resistance which first resistance is also included in said second galvanic connecting means and has first and second ends at the first electrode of said first transistor and at the first electrode of said second transistor, respectively;

wherein a second resistance has first and second ends at said first terminal and at the first electrode of said first transistor, respectively, and is included in both said first and said second galvanic connecting means; and wherein said means directly responsive to the potential at said third terminal for controlling the potentials at the third electrodes of said first and second transistors includes a fifth terminal to which the first electrode of said fifth transistor connects, the potential follower action of said fifth transistor providing at said fifth terminal a reference potential referred to said first terminal, and means for applying at least a portion of said reference potential to the third electrodes of said first and second transistors.

13. A self-balancing bridge network as set forth in claim 12 wherein said means for applying at least a portion of said reference potential to the third electrodes of said first and second transistors consists of a potential divider for applying a fixed fraction of said reference potential to the third electrodes of said first and second transistors.

14. A self-balancing bridge network as set forth in claim 8 or 10 wherein said means directly responsive to the potential at said third terminal for controlling the potentials of said first and second transistors comprises the potential follower action of said fifth transistor as provided between its third electrode and its first electrode and means for applying to an interconnection between the third electrodes of said first and second transistors at least a portion of the potential appearing between said first terminal and the first electrode of said fifth transistor.

15. A self-balancing bridge network as set forth in claim 5, 8, 10 or 11 wherein said current feedback means comprises:

a first resistance which is included in said sixth galvanic connecting means and has first and second ends at the first electrode of said third transistor and at the first electrode of said fourth transistor, respectively.

16. A self-balancing bridge network as set forth in claim 15 wherein a second resistance has first and second ends at said second terminal and at the first electrode of said third transistor, respectively, and is included in both said fifth and said sixth galvanic connecting means; wherein means are included for utilizing a reference potential developed between said second terminal and the output connection of said differential-input amplifier; and wherein means are included for applying at least a portion of said reference potential to the third electrodes of said third and fourth transistors.

17. A self-balancing bridge network as set forth in claim 16 wherein said means for applying at least a portion of said reference potential to the third electrodes of said third and fourth transistors consists of a potential divider for applying a fixed fraction of said reference potential to the third electrodes of said third and fourth transistors.

18. A self-balancing bridge network as set forth in claim 10 or 9 wherein said current feedback means comprises:

a first resistance which is included in said second galvanic connecting means and has first and second ends at the first electrode of said first transistor and at the first electrode of said second transistor, respectively.

19. A self-balancing bridge network as set forth in claim 10 or 9 wherein said current feedback means includes a first resistance, which first resistance is also included in said second galvanic connecting means and has first and second ends at the first electrode of said first transistor and at the first electrode of said second transistor, respectively;

wherein a second resistance has first and second ends of said first terminal and at the first electrode of said first transistor, respectively, and is included in both said first and said second galvanic connecting means; and wherein said means directly responsive to the potential at said third terminal for controlling the potentials at the third electrodes of said first and second transistors includes potential follower means for providing a reference potential as referred to said first terminal, which reference potential follows the potential at said third terminal, and means for applying at least a portion of said reference potential to the third electrodes of said first and second transistors.

20. A self-balancing bridge network as set forth in claim 9 wherein said means for applying at least a portion of said reference potential to the third electrodes of said first and second transistors consists of a potential divider for applying a fixed fraction of said reference potential to the third electrodes of said first and second transistors.

21. A self-balancing bridge network comprising:

first and second terminals defining an input port for connection to an energizing supply;

third and fourth terminals defining an output port;

first and second transistors of a first conductivity type and third and fourth transistors of a second conductivity type complementary to the first conductivity type, each of said transistors having respective first and second electrodes defining the ends of its principal current conduction path and having a respective third electrode, the conduction of its principal current path being controlled by potential appearing between its first and third electrodes;

means for connecting said first and second transistors as a first current amplifier having an input connection at said third terminal, having a common connection at said first terminal, and having an output connection at said fourth terminal, said means including first and second galvanic connecting means between said first terminal and the first electrodes respectively of said first transistor and of said second transistor, third galvanic connecting means between the second electrode of said first transistor and said third terminal, fourth galvanic connecting means between the second electrode of said second transistor and said fourth terminal, and means directly responsive to the potential at said third terminal for controlling the potentials at the third electrodes of said first and second transistors, thereby completing a direct coupled voltage feedback connection between the second and third electrodes of said first transistor;

means for connecting said third and fourth transistors as a second current amplifier having an input connection at said fourth terminal, having a common connection at said second terminal, and having an output connection at said third terminal, including fifth and sixth galvanic connecting means between said second terminal and the first electrodes respectively of said third transistor and of said fourth transistor, seventh galvanic connecting means between the second electrode of said third transistor and said fourth terminal, eighth galvanic connecting means between the second electrode of said fourth transistor and said third terminal, and differential-input amplifier means having inverting and non-inverting input connections respectively at said third and fourth terminals and having an output connection for directly controlling the potentials at the third electrodes of said third and fourth transistors; and current feedback means included in at least one of said first and second current amplifiers to differentially degenerate the gains of its said transistors for reducing the product of the current gains of said first and second current amplifiers, said self-balancing bridge network being improved in that said differential-input amplifier means includes fifth and sixth transistors of a conductivity type complementary to said first conductivity type, each having respective first and second electrodes defining the ends of its principal current conduction path and having a respective third electrode, the conduction of its principal current conduction path being controlled by potential appearing between its first and third electrodes, the inverting and non-inverting input connections of said differential-input amplifier respectively being at the third electrode of said fifth transistor and at the third electrode of said sixth transistor, means for completing connection of said fifth and sixth transistors in long-tailed-pair configuration including means for applying tail current to an interconnection of the first electrodes of said fifth and sixth transistors;

a seventh transistor of said first conductivity type having first and second electrodes defining the ends of its principal current conduction path and having a third electrode, the conduction of its principal current conduction path being controlled by potential appearing between its first and third electrodes;

means connecting said seventh transistor in common first electrode amplifier configuration, including means for direct coupling the second electrode of said seventh transistor to the output connection of said differential-input amplifier; and means differentially combining the current flowing through the second electrode of said fifth transistor with the current flowing through the second electrode of said sixth transistor for applying current to a node to which the third electrode of said seventh transistor connects.

22. A self-balancing bridge network as set forth in claim 21 wherein said current feedback means comprises a first resistance which is included in said sixth galvanic connecting means and has first and second ends at the first electrode of said third transistor and at the first electrode of said fourth transistor, respectively.

23. A self-balancing bridge network as set forth in claim 22 wherein a second resistance has first and second ends at said second terminal and at the first electrode of said third transistor, respectively, and is included in both said fifth and said sixth galvanic connecting means; wherein means are included for utilizing a reference potential developed between said second terminal and the output connection of said differential-input amplifier; and wherein means are included for applying at least a portion of said reference potential to third electrodes of said third and fourth transistors.

24. A self-balancing bridge network as set forth in claim 23 wherein said means for applying at least a portion of said reference potential to the third electrodes of said third and fourth transistors consists of a potential divider for applying a fixed fraction of said reference potential to the third electrodes of said third and fourth transistors.

* * * * *

UNITED STATES PATENT AND TRADEMARK OFFICE

CERTIFICATE OF CORRECTION

PATENT NO. : 4,234,841
DATED : November 18, 1980
INVENTOR(S) : Otto Heinrich Schade, Jr.

It is certified that error appears in the above—identified patent and that said Letters Patent is hereby corrected as shown below:

Column 5, line 27, change "an" to --a--.

Column 15, line 2, after "electrodes" insert --defining the ends of its principal current conduction path and having a respective third electrode, the conduction of its principal current path being controlled by potential appearing between its first and third electrodes;

means for connecting said first and second transistors as a first current amplifier having an input connection at said third terminal, having a common connection at said first terminal, and having an output connection at said fourth terminal, said means including first and second galvanic connecting means between said first terminal and the first electrodes respectively of said first transistor and of said second transistor, third galvanic connecting means between the second electrode of said first transistor and said third terminal, fourth galvanic connecting means between the second electrode of said second transistor and said fourth terminal, and

UNITED STATES PATENT AND TRADEMARK OFFICE

CERTIFICATE OF CORRECTION

PATENT NO. : 4,234,841

DATED : November 18, 1980

INVENTOR(S) : Otto Heinrich Schade, Jr.

It is certified that error appears in the above—identified patent and that said Letters Patent is hereby corrected as shown below:

means directly responsive to the potential at said third terminal for controlling the potentials at the third electrodes of said first and second transistors, thereby completing a direct coupled voltage feedback connection between the second and third electrodes of said first transistor;

means for connecting said third and fourth transistors as a second current amplifier having an input connection at said fourth terminal, having a common connection at said second terminal, and having an output connection at said third terminal, including--.

Signed and Sealed this

*Seventeenth* Day of *March 1981*

[SEAL]

*Attest:*

RENE D. TEGTMEYER

*Attesting Officer*

*Acting Commissioner of Patents and Trademarks*